US005113204A

United States Patent [19]

Miyazawa et al.

[11] Patent Number: 5,113,204

[45] Date of Patent: May 12, 1992

[54] INK JET HEAD

[75] Inventors: Yoshinori Miyazawa; Hidenori Omae; Takayuki Ishii; Haruhiko Koto; Fujio Akahane, all of Nagano, Japan

[73] Assignee: Seiko Epson Corporation, Tokyo, Japan

[21] Appl. No.: 511,259

[22] Filed: Apr. 19, 1990

[30] Foreign Application Priority Data

| | | | |
|---|---|---|---|
| Apr. 19, 1989 | [JP] | Japan | 1-99103 |
| Apr. 19, 1989 | [JP] | Japan | 1-99104 |
| May 26, 1989 | [JP] | Japan | 1-133010 |

[51] Int. Cl.[5] ..... B41J 2/01; B41J 2/045

[52] U.S. Cl. ..... 346/140 R

[58] Field of Search ..... 346/140 PD, 75

[56] References Cited

U.S. PATENT DOCUMENTS

| | | | |
|---|---|---|---|
| 3,925,791 | 12/1975 | Hunt | 346/140 R |
| 4,158,847 | 6/1979 | Heinzl et al. | 346/140 R |
| 4,243,995 | 1/1981 | Wright et al. | 346/140 R |
| 4,459,601 | 7/1984 | Howkins | 346/140 R |
| 4,631,557 | 12/1986 | Cooke et al. | 346/140 R |
| 4,779,099 | 10/1988 | Lewis | 346/1.1 |
| 4,998,120 | 3/1991 | Koto et al. | 346/140 R |

FOREIGN PATENT DOCUMENTS

| | | |
|---|---|---|
| 0067889 | 12/1982 | European Pat. Off. . |
| 0338590 | 10/1989 | European Pat. Off. . |
| 1418274 | 12/1975 | United Kingdom . |

OTHER PUBLICATIONS

Kiyoji Momose, "Ink Jet Recording Apparatus", Patent Abstracts of Japan, Jun. 1988, vol. 12, No. 222 (M-712) (3069).

*Primary Examiner*—Benjamin R. Fuller
*Assistant Examiner*—Alrick Bobb
*Attorney, Agent, or Firm*—Cushman, Darby & Cushman

[57] ABSTRACT

An ink jet head for a recording apparatus comprises: a nozzle-formed member having a plurality of nozzle orifices; a heating member for heating ink which is solid at ambient temperature to liquefy the ink; a piezoelectric converter spaced apart from the nozzle-formed member for causing the liquefied ink to be loaded between the piezoelectric converter and the nozzle-formed member and for jetting the liquefied ink loaded therebetween through the nozzle-formed member; and a member for relatively displaceably positioning the nozzle-formed member.

7 Claims, 5 Drawing Sheets

INK JET HEAD

BACKGROUND OF THE INVENTION

1. Field of the Invention

This invention relates to an ink jet type recording apparatus such as a printer which forms ink images on a medium such as recording paper by melting an ink that is solid at ambient temperature (hot-melt ink) and jetting the molten, and thus liquid droplets of ink. More particularly, it is directed to an ink jet printer head for use in the ink jet type recording apparatus.

2. Prior Art

A conventional ink jet type recording apparatus using hot-melt ink has the advantage of being compatible with many kinds of recording paper, of not causing the ink to evaporate while the apparatus is not being used, and of causing no clogging of its ink jetting nozzles. An ink jet head used in this apparatus has been constituted by a nozzle-formed member having a plurality of nozzle orifices, a heater, a piezoelectric converter, and an ink reservoir, and the nozzle-formed member has been unitized with the head forming members including the piezoelectric converter (U.S. Pat No. 4,631,557, Japanese Utility Model Application (UPA) No. 41652/1981 (the term "UPA" as used herein means "Unexamined Published Application").

The above-described conventional ink jet head has a structure in which its components having different thermal expansion coefficients are subjected to thermal stresses due to temperature variations that result from the melting of the ink. Deformations of the components caused by the thermal stress impose problems in terms of ensuring proper accuracy for stable performance and achieving undamageable structures for high reliability.

SUMMARY OF THE INVENTION

An object of this invention is therefore to eliminate the thermal stresses caused in association with temperature variations by overcoming the above problems, and thus to achieve stable performance and high reliability.

An ink jet head according to the present invention comprises a nozzle-formed member having a plurality of nozzle orifices, a piezoelectric converter, and heating means, in which a solid ink is molten by the heating mean, the molten ink is loaded between the nozzle-formed member and the piezoelectric converter, and the loaded ink is jetted by the piezoelectric converter.

In such an ink jet head, the nozzle-formed member is supported so as to be relatively displaceable by receiving the pressing force pressed to either the piezoelectric converter or its supporting member.

Further, in such an ink jet head, the nozzle-formed member is supported so as to be relatively displaceable by being guided by its supporting member.

Still further, in such an ink jet head, the nozzle-formed member is firmly bonded to a supporting member whose thermal expansion coefficient is substantially equal to the nozzle-formed member, and the piezoelectric converter is firmly bonded to a supporting member whose thermal expansion coefficient is substantially equal to the piezoelectric converter.

In the above arrangements of the present invention, the nozzle-formed member is supported so as to be displaceable relative to another member. This allows the nozzle-formed member to be expanded and contracted freely, thereby releasing it from thermal stresses. The absence of thermal stresses in the nozzle-formed member, which must be maintained at high temperatures to jet the liquid ink, contributes to ensuring high accuracy in dimensions and reducing stresses.

Moreover, in the above arrangements of the present invention, both the nozzle-formed member and the piezoelectric converter are firmly bonded by the supporting members whose thermal expansion coefficients are equal to the supported, so that they are free from the thermal stresses which different thermal expansion coefficients cause as the temperature varies in association with the melting of the ink.

BRIEF DESCRIPTION OF THE DRAWINGS

FIG. 3 (*b*) is a perspective view of a piezoelectric converter unit;

DETAILED DESCRIPTION OF THE PREFERRED EMBODIMENTS

This invention will next be described with reference to embodiments thereof.

Figure 1:
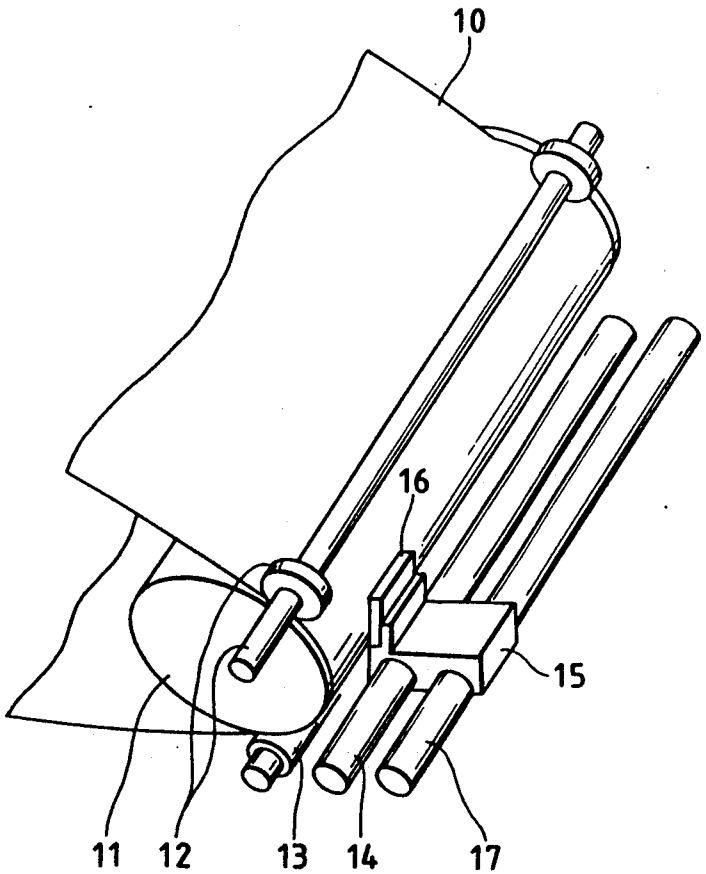
FIG. 1 is a perspective view showing a printer having an ink jet head which is an embodiment of this invention.

FIG. 1 is a perspective view of a printer showing an embodiment of this invention. In the figure, a sheet of recording paper 10 is wound around a platen 11 and pressed by forwarding rollers 12 and 13. An ink jet head 16 is mounted on a carriage 15 that is guided by guide shafts 14 and 17 and is movable in a direction parallel to the platen shaft. The ink jet head 16 has a plurality of nozzles, each of which can jet ink droplets independently of one another under control; scans along the platen shaft; and selectively jet the ink droplets to form an ink image on the recording paper 10. The recording paper 10 is transferred in a minor scanning direction that is perpendicular to the main scanning direction by the rotation of the forwarding rollers 12 and 13 to print the image on the surface of the recording paper.

Figure 2:
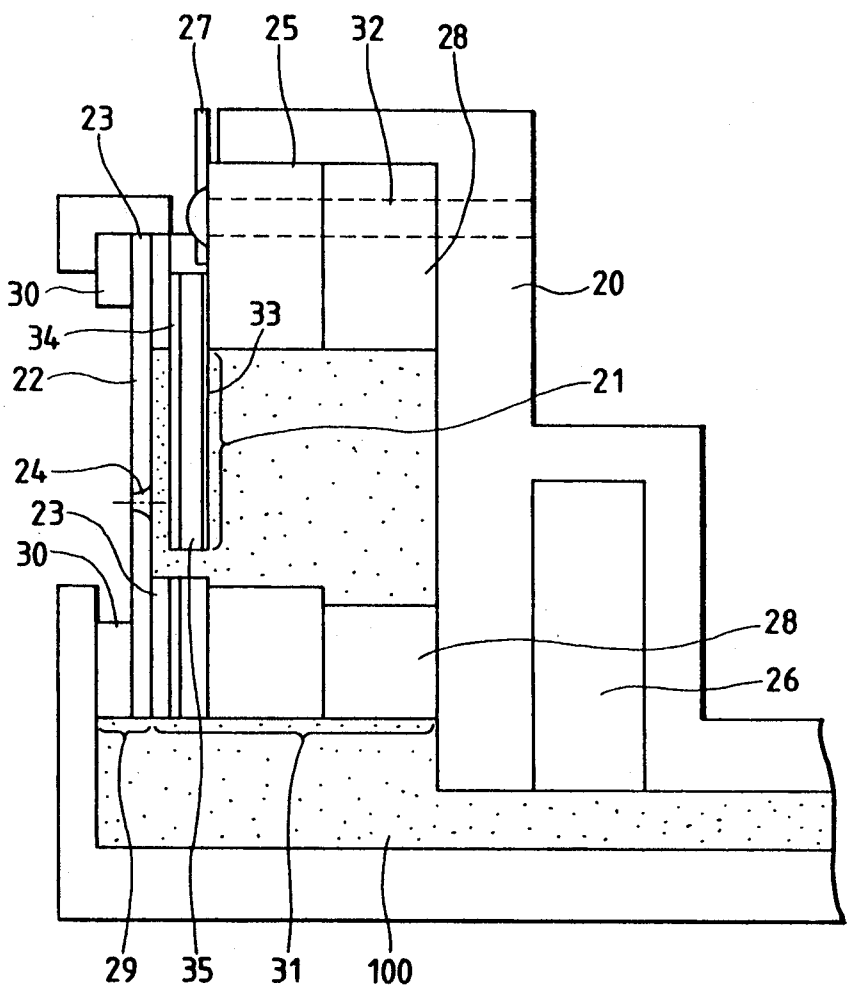
FIG. 2 is a sectional view of the ink jet head of the embodiment.

FIG. 2 is a sectional view of an ink jet head that is the embodiment of this invention. This ink jet head comprises: a converter unit 31 in which a base material 25, a piezoelectric converter 21, a spacer 23, and a permanent magnet 28 are fixed and unitized with a wiring 27 provided. It also has a heater 26, mounted on a frame 20, for melting the ink on the head and keeping the temperature of the ink over the melting point. The heater 26 is fixed by a bonding material. A nozzle-formed board 22, integral with a reinforcement board 30, is positioned on the converter unit 31 and supported so as to be relatively displaceable. That is, the nozzle-formed board 22 is pressed toward the base 25 by the attraction of the permanent magnet 28. The piezoelectric converter 21 comprises a vibrator element of multilayer structure. More specifically, the vibrator element consists of a piezoelectric material layer 35 made of PZT interposed between an electrode layer 33 made of an Au (gold) foil and a metal layer 34 made of a Ni foil.

Figure 3B:
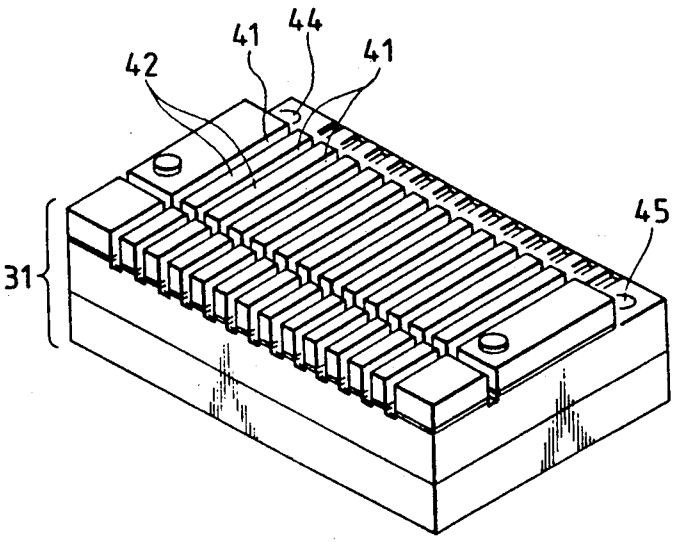
FIG. 3 (*a*) is a perspective view showing the process of manufacturing the peripheral portions of a piezoelectric converter of the ink jet head of the embodiment.
Figure 3A:
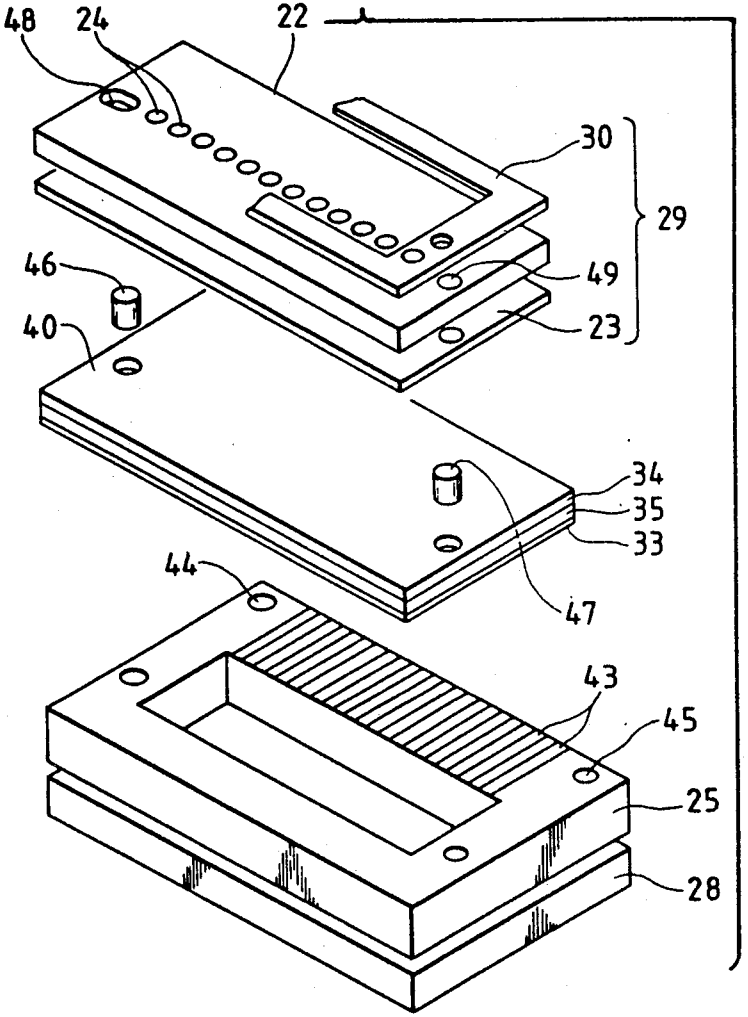

FIG. 3(*a*) and 3(*b*) show arrangements of the converter unit 31 and the peripheral portions thereof, respectively, in which the same members as those shown in FIG. 2 will be designated by the same reference numbers. FIG. 3(*a*) shows the manufacturing process of the converter unit. The multilayer board 40 forming vibrator element, the base material 25, the spacer 23, and the permanent magnet 28 are integrally bonded by a thermally resistant bonding agent or the like. Thereafter, as shown in FIG. 3(*b*), a plurality of grooves 41 are arranged by a dicing process to form the piezoelectric converter 21 having a plurality of vibrator elements that can be driven independently of one another. The plurality of cantilevered vibrator elements, each of which is free from interference can be prepared by forming the grooves 41 as deep as to the base material 25. The base material 25 is made of an isolating body (glass, ceramic, or the like) whose upper end is provided with an electrode pattern 43 that will be electrically connected. In order to connect to an external drive circuit, the electrode pattern 43 on the base material 25 is bonded to the wiring 27 of a flexible board that has a corresponding wiring pattern confronting with the electrode pattern 43, as shown in FIG. 2. An electrode for maintaining an equal potential for each vibrator element 21 is electrically connected when the spacer 23 is bonded to the surface of the metal layer 34 which is opposite to the side of the electrode layer 33.

An assembling arrangement of the converter unit 31 and its peripheral members into the head body will next be described with reference to FIGS. 2 and 3. The nozzle-formed board 22 is composed of a Ni thin board having a plurality of nozzles 24, and constitutes a nozzle-formed board unit 29 by being integrally bonded to the reinforcement member 30 made likewise of a Ni board and covering the periphery of the nozzle-formed board 22. The converter unit 31 is positioned by a positioning pin (not shown) fixed on the frame 20 and a hole 44, and secured to the frame 20 with a screw 32. Then, the nozzle-formed board unit 29 is mounted on the converter unit 31 with pins 46 and 47 so that their relative position can be maintained. One of the holes arranged on the nozzle-formed board 22 corresponding to the pins 46 and 47 is an oval hole 48, so that the nozzle-formed board unit 29 can be positioned by referencing only the other hole 49. Since nickel is a ferromagnetic material, it is attracted by the permanent magnet 28 and thus set to a predetermined position. Nickel, with its curie temperature being as high as 350° C. and its magnetic property maintained at high temperatures, does not lose its attracting force during the operation.

Figure 4:
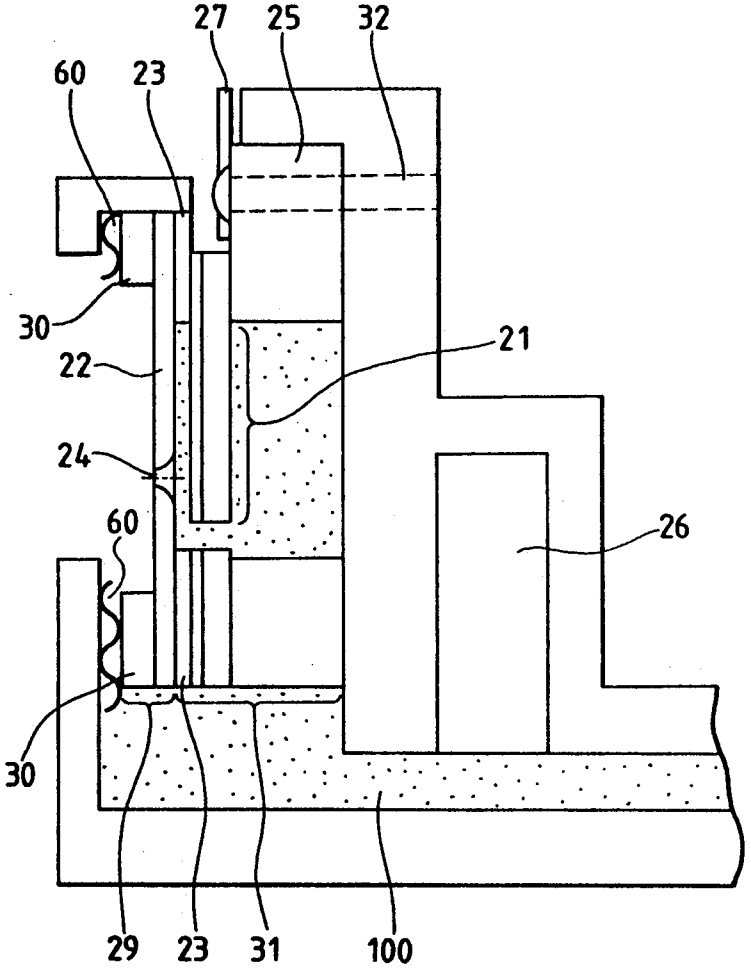
FIG. 4 is a sectional view of an ink jet head which is a further embodiment of this invention.
Figure 6:
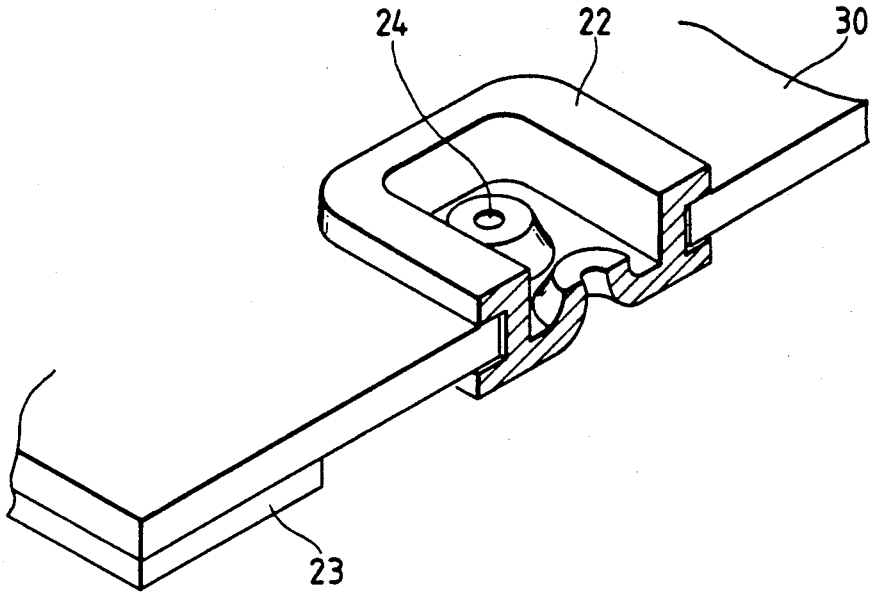
FIG. 6 is a perspective view showing a nozzle-formed board and nozzle-formed board supporting member for use in the ink jet heads according to this invention.

A further embodiment of this invention will be shown in FIG. 4. Unlike the embodiment shown in FIG. 2, the converter unit and the nozzle-formed board 22 in this embodiment are supported so as to be relatively displaceable by receiving the pressing force of a spring 60. Since the operation and the like are the same as in the embodiment shown in FIG. 2, the descriptions thereof will be omitted.

Figure 5:
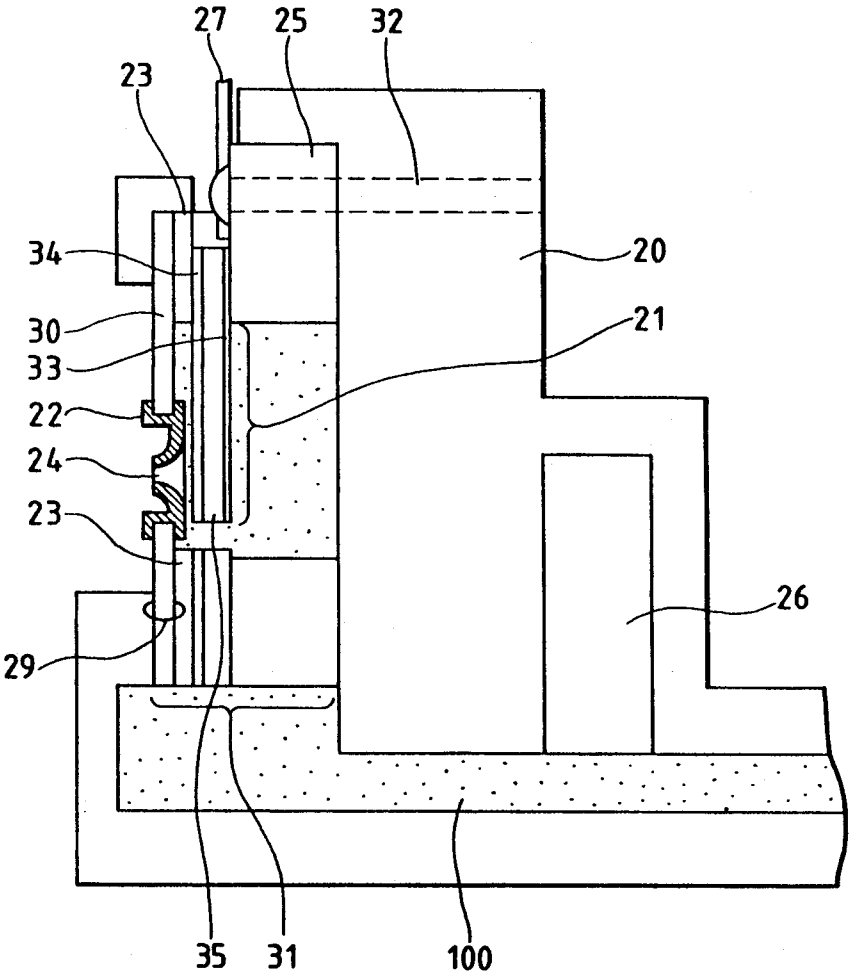
FIG. 5 is a sectional view of an ink jet head which is a still further embodiment of this invention.

A still further embodiment shown in FIG. 5 uses no permanent magnet 28, unlike the embodiment of FIG. 2. In the embodiment shown in FIG. 5, a base material 25, a piezoelectric converter 21, and a spacer 23 are fixed in advance, and a nozzle-formed board 22 and a nozzle-formed board supporting member 230 for guiding the nozzle-formed board 22 are fixed thereon to form a unitized converter unit 31.

The nozzle-formed board 22 is made of a Ni thin board having a plurality of nozzles 24 and is guided and supported by the nozzle-formed board supporting member 230 that covers the periphery of the nozzle-formed board 22 to constitute a nozzle-formed board unit 29. This nozzle-formed board 22 is made of invar.

The operation will next be described. At the printing start, electric power is supplied to the heater 26 to liquefy the ink 100 in the head by melting. In this embodiment, a solid ink whose main constituent is wax is used, and it is maintained at a predetermined temperature between 100° and 200° C. with a predetermined viscosity required to satisfy a certain jetting performance. By applying a voltage between the electrode layer 33 and the metal layer 34 formed on both sides of the vibrator element 42 through the wiring 27, the piezoelectric material layer 35 is contracted while the metal layer 34 is not contracted, so that a bending moment is caused to displace the tip of the vibrator element 42 in the direction of its thickness. When this voltage is removed, the pressure caused by the displacement derived from the elastic restoring force of the vibrator element causes the ink to jet from the nozzles 24.

As is apparent from the above description, the unitization of the head with the member whose thermal expansion coefficient is different from that of the head itself causes a thermal stress due to a difference in temperature between ambient temperature and the head that is heated and maintained as heated during the ink jetting operation. The thermal stress will be eliminated in the following manner with the above-described construction of this embodiment. Although the frame 20 made of aluminum has a large thermal expansion coefficient and the converter unit 31 a small thermal expansion coefficient, the relative positional deviation between the two members is very small. For instance, let it be supposed that a distance between the screw and the pin, i.e., the holes 44 and 45, is 40 mm; the thermal expansion coefficient of aluminum is 23E−6/° C. (the term "E−6" as used herein means "$10^{-6}$"); the thermal expansion coefficient of PZT (PZT is used as the material of the converter unit 31) is 1.8E−6/° C. Then, the dimensional difference caused at both ends when the temperature difference is 200° C. can be calculated to be 170 μm. Such a small deviation can be absorbed by the elastic deformation of the screw in this arrangement, in which the one end the converter unit .is positioned by the pin and the other is screwed. Therefore, the converter unit is neither subjected to application of excessive external forces nor deformation. In order to reduce thermal stresses within the converter unit, it is desirable that each member constituting the converter unit 31 should have a substantially equal thermal expansion coefficient. Thus, the material must be selected from this viewpoint. In this embodiment, the base material 25 is made of glass or ceramic; the piezoelectric material, PZT; the metal layer 34, invar, which is a metal having a low thermal expansion coefficient; and the spacer 23 is likewise made of invar, so that the above requirement can be satisfied. As the permanent magnet, a sintered rare earth metal magnet, a ferrite magnet, or the like can be used as having a high coercive force at high temperatures and a proper thermal expansion coefficient. They may be bonded by a soft type bonding agent such as a silicon rubber.

On the other hand, the distance between the vibrator element and the nozzle-formed board must be controlled accurately to ensure a certain ink jetting performance. For instance, according to the results of the experiments conducted by the inventor and others using a vibrator element of 0.1 mm in thickness, such a distance must be controlled to 5 to 40 $\mu m \pm 10$ $\mu m$ depending on the viscosity of the ink. The thickness of the nozzle-formed board is 30 to 150 $\mu m$ to reduce the fluid resistance to which the ink is subjected. However, the restrictions including the thickness of the nozzle-formed board, the space, and the like impose limits on the strength and dimensions of the respective components, and this does not allow the converter unit to be provided with the screw. For this reason, it is necessary to make an arrangement so that the external forces to be applied to the components can be accurately controlled and the thermal stresses can be removed in such a manner as to maintain the dimensions of the components unchanged. The nozzle-formed board, generally having to accommodate a number of very small nozzles, is subjected to restrictions in terms of the material to be used and the machining method. For instance, nickel is electroformed. In the structure of the embodiment shown in FIG. 2, the converter unit 31 and the nozzle-formed board are attracted by a magnetic attraction that provides them with an average pressure. Relative displacements allowed to both components help relieve the stress with the relative position held by the positioning pin. With this arrangement, the distance between the nozzle-formed board and the vibrator element constituting the conversion unit can be controlled accurately as demanded to ensure a prescribed performance even in the case where the material such as nickel that has a thermal expansion coefficient different from that of the converter unit. The high bending strength provided by the reinforcement board prevents generation of buckling and warpage and thus permits smooth sliding at its boundaries.

The embodiment shown in FIG. 5 is arranged so that the nozzle-formed board is engaged with and thus guided by the nozzle-formed board supporting member and is supported so as to be relatively displaceable. Thus, their relative displacement permits stresses caused by expansion of the nozzle-formed board to be relieved. The nozzle-formed board can be assembled into the nozzle-formed board supporting member when the former is in contraction at low temperatures. Instead, the nozzle-formed board supporting member may be arranged in separate piece and unitized after the nozzle-formed board has been assembled.

Figure 7:
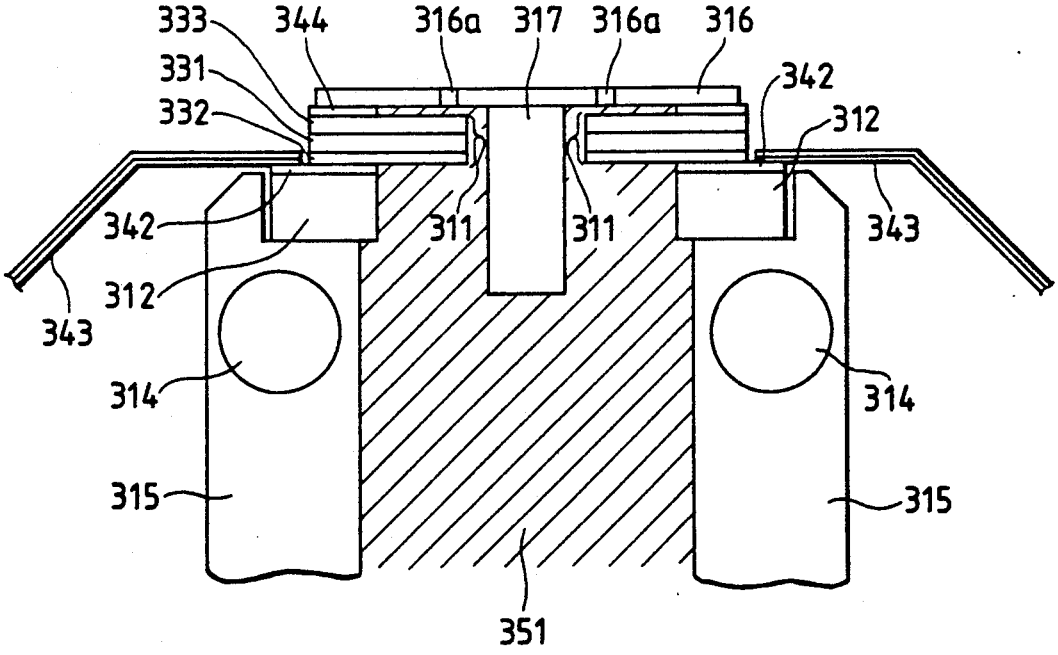
FIG. 7 and 8 are sectional views of an ink jet head which is a still further embodiment of this invention.

FIG. 7 shows a sectional view of an ink jet head which is a still further embodiment of this invention. A cantilevered piezoelectric converter 331 is of multilayer structure with a piezoelectric material layer 331 of PZT interposed between an electrode 332 made of an Au foil and a metal layer 333 made of a foil of invar that is an alloy whose thermal expansion coefficient is substantially equal to that of PZT, and is bonded to the base 312 made of a ceramic material whose thermal expansion coefficient is substantially equal to that of PZT. A base 312 that is made of an isolating material has on its upper surface an electrode pattern 342 that is to be electrically connected. In order to connect the electrode 332 of a piezoelectric converter 311 to an external drive circuit, a wiring 343 of a flexible board that has a corresponding wiring pattern confronting with the electrode pattern 342 is bonded so that the wiring patterns and the electrode are in conduction. The electrode for maintaining each piezoelectric converter 11 at the same potential is electrically wired when the spacer 344 is bonded on the metal layer 333 surface, which is the side opposite to the electrode. Further, the base 312 is arranged on a holder 315 having a built-in heater 314 for melting the ink in the head and maintaining the temperature over the melting point. On the other hand, a nozzle-formed board 316 having a plurality of nozzles **316*a* fabricated by subjecting Ni to an electroforming process is secured to a center frame 317** made of a stainless material whose thermal expansion coefficient is substantially equal to that of the nozzle-formed board by means of welding.

Figure 8:
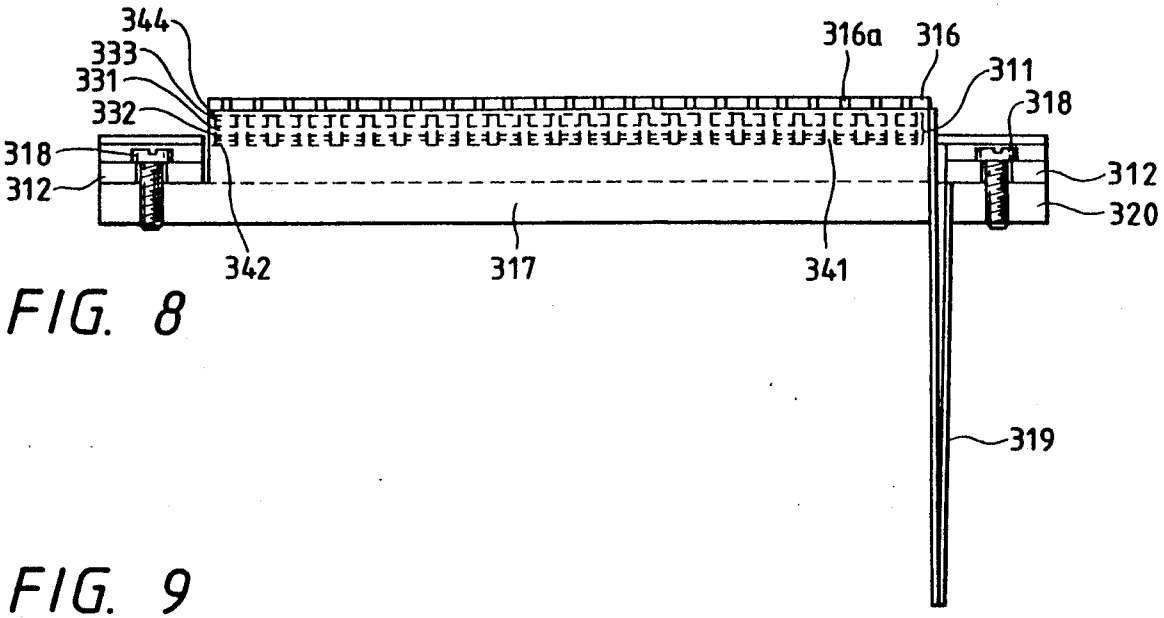

FIG. 8 is a sectional view of the ink jet head shown in FIG. 7 when viewed from the left side of the drawing. In order to form a plurality of piezoelectric converters 311, each being driven independently, the flat piezoelectric converter 311 secured to the base 312 is divided by forming grooves 341 by a dicing process. The forming of the grooves 341 that are as deep as to the base 312 allows a plurality of piezoelectric converters 311 that do not interfere with one another to be prepared. The center frame 317 has one of its ends secured to the base 312 directly by the screw 318, and the other end provided with the top ends of a V-shaped member made up of two plate springs 319 welded at one of their ends. The shorter one of the top ends of the V-shaped plate springs 319 is welded to a mounting plate 320 made of the same material as that of the center frame 317, and the mounting plate 320 is secured to the base 312 by the screw 318. At this time, the nozzle-formed board 316 is adjusted so that a predetermined clearance is provided with respect to the piezoelectric converter 311 by the spacer 344.

The operation will next be described. At the printing start in FIG. 7, electric power is supplied to the heater 314 and the ink 351 within the head is liquefied by melting. In this embodiment, a solid ink whose main constituent is wax is used, and it is maintained at a predetermined temperature between 100° and 200° C. with a predetermined viscosity required to satisfy a certain jetting performance. By applying a voltage between the electrode layer 332 and the metal layer 333 formed on both sides of the piezoelectric converter 311 through the wiring 343, the piezoelectric material layer 331 is contracted while the metal layer 333 is not contracted, so that a bending moment is caused to displace the tip of the piezoelectric converter 311 in the direction of its thickness (the downward direction in the figure). When this voltage is removed, the pressure caused by the displacement derived from the elastic restoring force of the piezoelectric converter 311 causes the ink to jet from the nozzles **316*a* of the nozzle-formed board 316**. This operation is repeated in accordance with a printing signal to perform a desired printing operation.

As is apparent from the above description, thermal stresses are caused during the ink jetting operation if the head is unitized with a member whose thermal expansion coefficient is different from itself; because as the head is heated to a high temperature, there exists a temperature difference between the high temperature and the ambient temperature. The components are more likely to be deformed or broken with larger temperature differences. Particularly, the clearance between the piezoelectric converter 311 and the nozzle-formed board 316 must be highly accurate in order to ensure the prescribed ink jetting performance. For instance, according to the results of an experiment conducted by the inventor and his group using a PZT of 0.1 mm in thickness, such a clearance must be controlled to 5 to 40 $\mu m \pm 10$ $\mu m$ depending on the viscosity of the ink. With the arrangement of this embodiment, the thermal stresses will be relieved in the following manner. There is so small a difference in thermal expansion coefficient between the pair of the piezoelectric converter 311 and the base 312, and the pair of the nozzle-formed board 316 and the center frame 317, respectively that the thermal stresses to be caused will be small. More specifically, let it be supposed that the thermal expansion coefficient of the piezoelectric converter 311 using the value of PZT is 1.8E−6/° C. (the term "E−6" as used herein means "$10^{-6}$"); and that of the base 312, using the value of ceramic, is 2E−6/° C. Then, the dimensional difference caused by a temperature difference of 200° C. between the piezoelectric converter 311 of 40 mm in flat plate and the base 312 is as small as 1.6 $\mu m$. On the other hand, if the thermal expansion coefficient of the nozzle-formed board 316 using the value of Ni is 12.8E−6/° C., and that of the center frame 317 using the value of a stainless steel is 13E−6/° C., then, the dimensional difference with a temperature difference of 200° C. is 1.6 $\mu m$. If the piezoelectric converter 311 and the nozzle-formed board 316 are unitized, the dimensional difference caused under the same condition is 88 $\mu m$, which is 50 times that of the case where the components whose thermal expansion coefficients are close to each other. Such a dimensional difference directly affects the respective components as a thermal stress. That is, the center frame 317 whose thermal expansion coefficient is large presses the base 312 so as to expand from within, resulting in deformation or breakage of either of the two. In order to absorb this dimensional difference, the center frame 317 is secured to the base 312 by interposing therebetween the screw 318 through the V-shaped plate spring 319 as shown in FIG. 8. Since the plate spring 319 is easily deformable with respect to a force in the length direction of the center frame 317, it can absorb the above-described dimensional differences caused by differences in thermal expansion coefficient. However, the plate spring 319 is rigid in directions orthogonal to the length direction of the center frame 317; i.e., the vertical direction with FIG. 8 viewed from the front and the direction of going through the sheet on which FIG. 8 is drawn. Therefore, the clearance between the piezoelectric converter 311 and the nozzle-formed board 316 can be maintained accurately. The respective nozzles 316*a* disposed on the nozzle-formed board 316 are arranged so that they coincide with the center of the respective piezoelectric converters 311 that are thermally expanded at an operating temperature.

Figure 9:
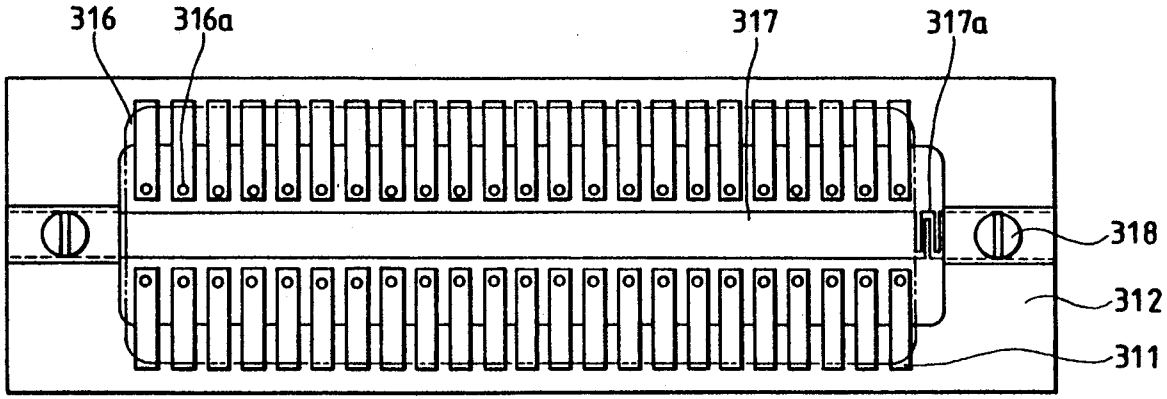
FIG. 9 is a schematic plan view of an ink jet head which is a still further embodiment of this invention.

FIG. 9 shows a still further embodiment of this invention, in which the number of components is reduced by arranging a dimensional difference absorbing unit 317*a* inside the center frame 317. The operation and the like, being similar to the previous embodiment, will be omitted.

As described in the foregoing pages, the present invention can maintain the clearance between the nozzle-formed board and the vibrator element as accurately as required with its arrangement adapted for relieving the stress caused by a change in temperature, thereby providing the advantage of not only preventing the deformation and breakage because it causes no significant stresses to the related components but also achieving high reliability.

The arrangement that allows relative sliding means absence of thermal stresses, and thus further provides the advantage of increasing the scope in selecting the material and thus of using highly machinable materials. Moreover, it is possible to operate at higher temperatures, thereby providing a wider choice of selecting the ink.

Furthermore, according to the present invention, it is possible to minimize the thermal stress due to changes in temperature and to absorb the dimensional difference between the materials whose thermal expansion coefficients greatly differ by the dimensional difference absorbing unit, thereby preventing deformation and breakage of the materials. Consequently, a stable performance can be achieved and a high reliability is ensured.

The arrangement that the nozzle-formed board and the center frame are secured in the vicinity of the nozzles also provides the advantage of accurately maintaining the clearance between the piezoelectric converter and the nozzle, which is important in terms of the ink jetting performance.

What is claimed is:

1. An ink jet head for a recording apparatus, comprising:

a nozzle unit which includes a nozzle-formed member having a plurality of nozzle orifices;

heating means for heating ink which is solid at ambient temperature to liquefy the ink;

a piezoelectric converter spaced apart from said nozzle-formed member for causing liquified ink to be loaded between said piezoelectric converter and said nozzle-formed member and for jetting loaded ink through said nozzle-formed member; and means for positioning said nozzle unit in said ink jet head for allowing the nozzle unit to be elastically displaced relative to the ink jet head to prevent the nozzle unit from incurring excessive stress due to thermal expansion and contraction.

2. An ink jet head as in claim 1, wherein said positioning means comprises means for indirectly applying a pressing force to said nozzle unit.

3. An ink jet head as in claim 2, wherein said positioning means comprises a permanent magnet, and wherein said nozzle unit comprises a ferromagnetic material.

4. An ink jet head as claimed in claim 2, wherein said positioning means comprises a spring.

5. An ink jet head as in claim 1, wherein said nozzle unit further comprises a supporting member for guidably supporting said nozzle-formed member, said supporting member being elastically displaceable relative to said ink jet head.

6. An ink jet head as in claim 1, wherein said positioning means comprises means for directly applying a pressing force to said nozzle unit.

7. An ink jet head for a recording apparatus, comprising:

a nozzle-formed member having a plurality of nozzle orifices;

heating means for heating ink which is solid at ambient temperature to liquefy the ink;

a piezoelectric converter spaced apart from said nozzle-formed member for causing liquified ink to be loaded between said piezoelectric converter and said nozzle-formed member and for jetting loaded ink through said nozzle-formed member;

a first supporting member to which said nozzle-formed member is firmly bonded, said first supporting member having a thermal expansion coefficient substantially equal to that of said nozzle-formed member;

a second supporting member to which said piezoelectric converter is firmly bonded, said second supporting member having a thermal expansion coefficient substantially equal to that of said piezoelectric converter; and means for allowing said nozzle-formed member to be elastically displaced relative to said piezoelectric converter to prevent the nozzle-formed member from incurring excessive stress due to thermal expansion and contraction.

* * * * *